US005873804A

United States Patent [19]

Fabre

[11] Patent Number: 5,873,804

[45] Date of Patent: Feb. 23, 1999

[54] DIGITAL POSITION INDICATOR

[75] Inventor: Mike Fabre, Baton Rouge, La.

[73] Assignee: Michael L. Fabre, Sr., Baton Rouge, La.

[21] Appl. No.: 658,730

[22] Filed: Jun. 5, 1996

[51] Int. Cl.[6] ..... A63B 21/00

[52] U.S. Cl. ..... 482/70; 482/909

[58] Field of Search ..... 482/70, 909, 114, 482/900, 902

[56] References Cited

U.S. PATENT DOCUMENTS

| | | | |
|---|---|---|---|
| 4,659,077 | 4/1987 | Stropkay | 482/70 |
| 4,728,102 | 3/1988 | Pauls | 482/909 |
| 4,770,411 | 9/1988 | Armstrong et al. | 482/909 |
| 5,246,412 | 9/1993 | Chen | 482/70 |
| 5,277,678 | 1/1994 | Friedebach et al. | 482/70 |
| 5,299,996 | 4/1994 | Chi | 482/70 |

*Primary Examiner*—Stephen R. Crow

[57] ABSTRACT

A digital resistance indicator for P.S.I. Nordic Track, of Chaska, Minn., under the mark NORDIC TRACK exercise machines is provided for use with exercise machines having a frictional resistance device for creating a resistive force in response to reciprocating arm movements by an operator. The resistance indicator comprises a resistance adjustment device, operatively connected to the frictional resistance device, for varying the level of the resistive force; and a digital indicator, coupled to the resistance adjustment device, for displaying a numerical value corresponding to a particular position of the resistance adjustment device. The resistance adjustment device may comprise a rotatable handwheel, a lever, or any other suitable element which can be grasped by the human hand and used to impart an increase or decrease in resistive force to the frictional resistance device. Preferably, the digital indicator can be adjusted independently of the position of the resistance adjustment device so that any desired numerical value can be made to correspond to a particular resistance setting. A stabilizer bracket is connected between the digital indicator and any fixed portion of the exercise machine for preventing movement of the digital indicator relative to the exercise machine while in use. If desired, the digital indicator may be coupled to the resistance adjustment device by a flexible shaft so that the digital indicator can be conveniently positioned for greater visibility to the operator.

1 Claim, 1 Drawing Sheet

DIGITAL POSITION INDICATOR

BACKGROUND OF THE INVENTION

I. Field of the Invention

The present invention relates generally to exercise equipment and more particularly to P.S.I. Nordic Track, of Chaska, Minn., under the mark NORDIC TRACK, ski machines and devices used in setting arm resistance levels on such equipment.

II. Description of Prior Art

Over the last few decades, a variety of medical and scientific advancements have reinforced the fact that frequent exercise can have tremendous health benefits. As a result, millions of persons have joined health and fitness clubs and purchased home exercise equipment. Some of the more popular types of exercise devices are of the cross-country skiing variety, particularly the ones manufactured by Nordic Track, Inc. Those devices generally comprise a pair of ski-like members which move relative to a frame, while a pair of rope-like extensions are pulled against a resistive force in coordination with the motion of the ski-like members. The resistance to arm movements is provided by a spring-loaded reaction member which is frictionally coupled to a rotatable drum on the exerciser, wherein the resistance to rotation is provided by tightening a threaded nut against the drum and the spring-loaded reaction member.

One version of the resistance indicator of the prior art is shown in U.S. Pat. No. 4,728,102, issued to Pauls, the disclosure of which is incorporated herein by reference. While this device does permit adjustment of the resistive force, there are a number of apparent deficiencies which are a result of its particular construction. First, the use of a moving needle against a marked plate does not provide a static resistance indication because the nut has to be adjusted through trial and error during exercise until the resistance needle indicates a satisfactory level. Once the setting is made, the level itself is not precise, because the needle can only indicate the maximum resistance while the user is exercising. Moreover, because of the analog nature of the Pauls device, one's perception of where the needle is depends on viewing angle and lighting conditions. These deficiencies are especially problematic when two or more persons use the exercise device, because the nut position and resistance must be adjusted between users with no repeatability of resistance for any given user. Consequently, the sequence of rough and fine adjustments each time the exercise device is used tends to detract from the overall exercise effectiveness because each user must stop and adjust the nut several times before finding his or her desired resistance setting. Finally, it is a common practice among persons who exercise to gradually increase the resistance as their upper body strength increases over time. Although the Pauls device can be adjusted, it is difficult to ascertain small differences in resistive force from one session to the next due to the coarse nature of indication by use of large springs.

Therefore, a more precise means of setting resistive force, such as a digital indicator, would result in more accurate settings, greater repeatability of settings between exercise sessions, and less frustration to the user by the elimination of trial and error methods of establishing a particular resistance setting. Furthermore, the setting can be applied before exercise begins, saving time for the exerciser. The proposed Preset Digital Resistance Indicator may be used in addition to the Pauls device.

SUMMARY OF THE INVENTION

It is therefore an object of this invention to provide a digital position indicator that is more curate than analog position indicators.

It is also an object of this invention to provide a digital position indicator that allows greater repeatability of resistance settings.

It is a further object of this invention to provide a digital position indicator that does not require operation of the exercise machine prior to establishing a desired resistance setting.

Yet another object of this invention is to provide a digital position indicator that is relatively inexpensive, simple to operate, and easily retrofitted onto existing exercise machines.

These and other objects and advantages of the present invention will no doubt become apparent to those skilled in the art after having read the following description of the preferred embodiment which are contained in and illustrated by the various drawing figures.

Therefore, in a preferred embodiment, a digital resistance setting indicator for arm exercise machines is provided for use with arm exercise machines having a frictional resistance device for creating a resistive force in response to reciprocating movements by an operator. The resistance indicator comprises resistance adjustment means, operatively connected to the frictional resistance device, for varying the level of the resistive force; and a digital indicator, coupled to the resistance adjustment means, for displaying a numerical value corresponding to a particular position of the resistance adjustment means. The numerical display may be effected through either mechanical or electronic means. The resistance adjustment means may comprise a rotatable handwheel, a lever, or any other suitable element which can be grasped by the human hand and used to impart an increase or decrease in resistive force to the frictional resistance device. Preferably, the digital indicator can be slipped independently of the position of the resistance adjustment means so that any desired numerical value can be made to correspond to a particular resistance setting. A stabilizer bracket is connected between the digital indicator and any fixed portion of the arm exercise machine for preventing movement of the digital indicator relative to the arm exercise machine. If desired, the digital indicator may be coupled to the resistance adjustment means by a flexible shaft so that the digital indicator can be conveniently positioned for greater visibility to the operator.

DETAILED DESCRIPTION OF THE PREFERRED EMBODIMENTS

Figure 2:
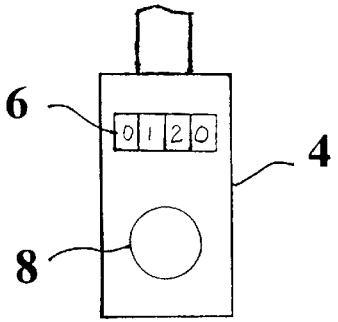
FIG. 2 is a front view of the invention of FIG. 1 with the frictional resistance device omitted for clarity.

In the drawings, certain details pertaining to fabrication and maintenance utility well established in the machine construction art and not bearing upon points of novelty are omitted in the interest of descriptive clarity and efficiency. Such details may include threaded connections, lockrings, shear pins, weld lines and the like.

Figure 1:
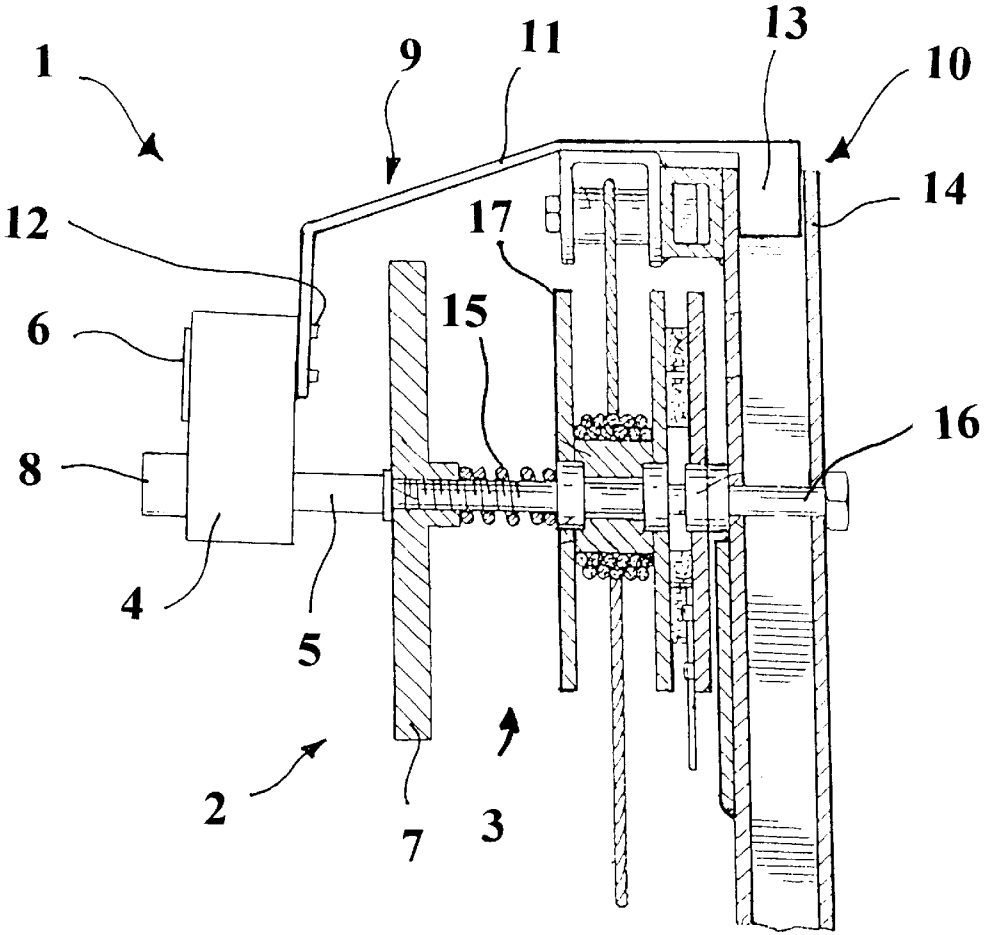
FIG. 1 is an elevation view of a preferred embodiment of the present invention.

Turning now to FIG. 1, a preferred embodiment 1 of the digital position indicator of the present invention is shown to comprise resistance adjustment means 2, operatively connected to a frictional resistance device 3 of an existing exercise machine, such as that shown in U.S. Pat. No. 4,728,102, for varying the level of the resistive force which will be experienced by an operator. The frictional resistance device 3 is intended to create a resistive force in response to reciprocating movements by an operator. The resistance device may comprise a spring 15 mounted over the threaded center pin 16. The spring's 15 compression against the flange 17 increases friction resistance to the exercise machine as indicated by Pauls. Digital indicating means 4 is coupled to the resistance adjustment means 2 by way of a flexible shaft 5 and displays a numerical value in a numerical display 6 corresponding to a particular degree position of he hand wheel 7. The means of attachment of flexible shaft 5 to the resistance adjustment means 2 may be accomplished by attaching the flexible shaft to the hand wheel 7, and it is especially important because it allows corresponding rotation of flexible shaft 5 upon rotation of hand wheel 7. This corresponding rotation is the position indication that the digital indicating means 4 displays and furthermore indicates the level of compression of the spring 15 i.e. inferred resistance. The use of flexible shaft 5 allows the digital indicating means 4 to be conveniently oriented for greater visibility to the operator. One example of a flexible shaft 5 used by the inventor is Part No. S55SS7-FS061504 provided by Stock Drive Products of Long Island, N.Y. However, a non-flexible shaft may also be employed if the orientation of digital indicating means 4 is not especially important to the operator. One embodiment of digital indicating means 4 is the "Multidial" manufactured by Spectrol Electronics as Model No. 15. The numerical display 6 may be effected through either mechanical or electronic means. The resistance adjustment means 2 may comprise a rotatable handwheel 7 or any other suitable element, such as a lever, which can be grasped by the human hand and used to impart an increase or decrease in resistive force to the frictional resistance means 3. To facilitate adjustment of the resistance, it is preferred that handwheel 7 be circular in shape with a diameter of approximately six inches, although variations of such shapes and dimensions would still be acceptable.

Preferably, the digital indicating means 4 can be adjusted independently of the position of the resistance adjustment means 2 by a knob 8 located on digital indicating means 4 so that any desired numerical value can be made to correspond to a particular resistance setting for frictional resistance device 3. For example, a user may desire a particular resistance setting which is known to result in a certain target heart rate of 120 beats per minute. Therefore, the knob 8 can be used to adjust the digital display 6 to a reading of "120" once the desired resistance level is set. If the resistance setting is changed as a result of use by other exercisers, the desired resistance level can be easily re-established by simply turning the hand wheel 7 until the digital display 6 reads "120".

As an alternative to the mechanical display of the numerical position information, digital indicating means 4 may employ an electronic display, such as an LCD display, powered by solar energy, batteries, or an external power source. Additionally, an electronic version of the digital indicating means 4 may also employ a pulse, linear motion, displacement transducer, or strain gauge encoding scheme (not shown) wherein the position of the hand wheel 7 can be determined, either optically, magnetically, or by pressure, relative to the digital indicating means 4. This position information would then be passed to the LCD display. An electronic resetting feature could also be employed so that a particular resistance setting can be established as a baseline setting from which higher or lower settings can be referenced.

Stabilizing means 9, such as a bracket 11, is connected between the digital indicating means 4 by screws 12 and any fixed portion 10 of the exercise machine for preventing movement of the digital indicating means 4 relative to the exercise machine. For example, bracket 11 may include a tab 13 which is matingly engageable with an open portion of the framework 14 of the exercise machine, as shown in FIG. 1.

From the foregoing description, it can be seen that each of the aforementioned objectives is satisfied by the present invention. Accurate settings are achievable and may be reliably repeated through a clear digital representation of the position of the resistance adjustment means. The invention is simple to operate and can easily be added as a retrofit to existing exercise machines of this type.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A preset digital resistance indicator for a ski exercise machine, said ski exercise machine having a frame, means for exercising a user's legs by permitting ski-style striding movement, and arm exercise means which includes a rotating drum having frictional resistance means for providing a variable load; said resistance indicator comprising:

(a) Resistance adjustment means including a rotatable hand wheel operatively connected to said frictional resistance means for varying the level of resistive force;

(b) An electronic digital indicating means for digitally displaying a numerical value which indicates the load applied to said frictional resistance means;

(c) Stabilizing means comprising a bracket connected to said indicating means and removably attached to said exercise machine; and (d) Coupling means comprising a flexible shaft connecting said indicating means to said resistance adjustment means.

* * * * *